United States Patent [19]

Browder

[11] 4,035,606

[45] July 12, 1977

[54] PORTABLE CUSHION APPARATUS

[76] Inventor: Thomas H. Browder, 7168 Forest City Road, Apt. No. 102, Orlando, Fla. 32810

[21] Appl. No.: 664,552

[22] Filed: Mar. 8, 1976

[51] Int. Cl.[2] ..... H05B 1/00

[52] U.S. Cl. ..... 219/211; 219/527; 219/528; 219/533

[58] Field of Search ..... 219/211, 212, 527–529, 219/533; 126/204; 178/376–379, 404; 2/84, 87, 88, 89

[56] References Cited

U.S. PATENT DOCUMENTS

| | | | |
|---|---|---|---|
| 2,346,998 | 4/1944 | Reveno | 126/204 |
| 3,500,014 | 3/1970 | Longo | 219/211 |
| 3,524,965 | 8/1970 | Arron | 219/211 |
| 3,835,471 | 9/1974 | Lankford | 2/84 |
| 3,837,006 | 9/1974 | Laseman | 2/89 |

*Primary Examiner*—C. L. Albritton

*Attorney, Agent, or Firm*—Duckworth, Hobby, Orman, Allen & Pettis

[57] ABSTRACT

A portable, foldable, and heatable cushion and raincoat apparatus has foldable carrying case with cushioning means attached thereinside and a raincoat having a portion attached thereinside so that it may be folded into a carrying case. The carrying case has a zippered enclosure and a handle for ease in carrying to spectator and sporting events to use as a cushion, and in inclement weather, to use as a raincoat or to keep warm. A heating element is attached inside the case to keep the user warm.

4 Claims, 5 Drawing Figures

PORTABLE CUSHION APPARATUS

BACKGROUND OF THE INVENTION

The present invention relates to a portable cushion for spectator events as well as fo fishing, hunting, or the like, which includes a garment for protection against inclement weather as well as a heating system.

In the past, it has been common to provide a great variety of portable cushions for use in sporting events, such as football and baseball games, where stadiums frequently provide only hard benches to sit upon. These cushions can be rented at many stadiums for the duration of the game. It has also been common to provide various types of foldable raincoats and ponchos which can be folded into carrying cases for storage and travel. Finally, it has been commom in the past to have heated cushions and electrically heated outdoor garments for providing heat to an individual in cold weather.

Typical prior art patents can be seen in the Weibel U.S. Pat. No. 3,443,066 for a heated garment and in the U.S. Pat. Nos. 3,017,493; 3,500,014; 3,427,431; and 3,524,965 dealing with heated cushions and garments. In contrast to these prior art cushions, heaters and ponchos, the present invention advantageously brings various elements together in a compact, foldable case which provides the comfort of a cushion, and in the event of inclement weather, provides protection against rain, snow, cold and windy weather. Additional space may be provided for carrying a thermos, or the like, while maintaining the overall appearance of a small briefcase.

SUMMARY OF THE INVENTION

A portable cushion and raincoat apparatus has a foldable zippered carrying case having handles thereon and having a cushion material attached thereinside so as to provide a seat cushion when folded or unfolded. The carrying case also has a poncho type raincoat attached thereinside which may be folded into the folded carrying case and opened up as needed to protect the owner from inclement weather. The poncho raincoat may have a head covering while the foldable carrying case may have a heating element therein for heating the user in cold weather. In addition, a belt or strap allows the carrying case to be connected around the waist of the user for standing events.

BRIEF DESCRIPTION OF THE DRAWINGS

Other objects, features and advantages of the present invention will be apparent from the written description and the drawings in which.

DESCRIPTION OF THE PREFERRED EMBODIMENT

Figure 1:
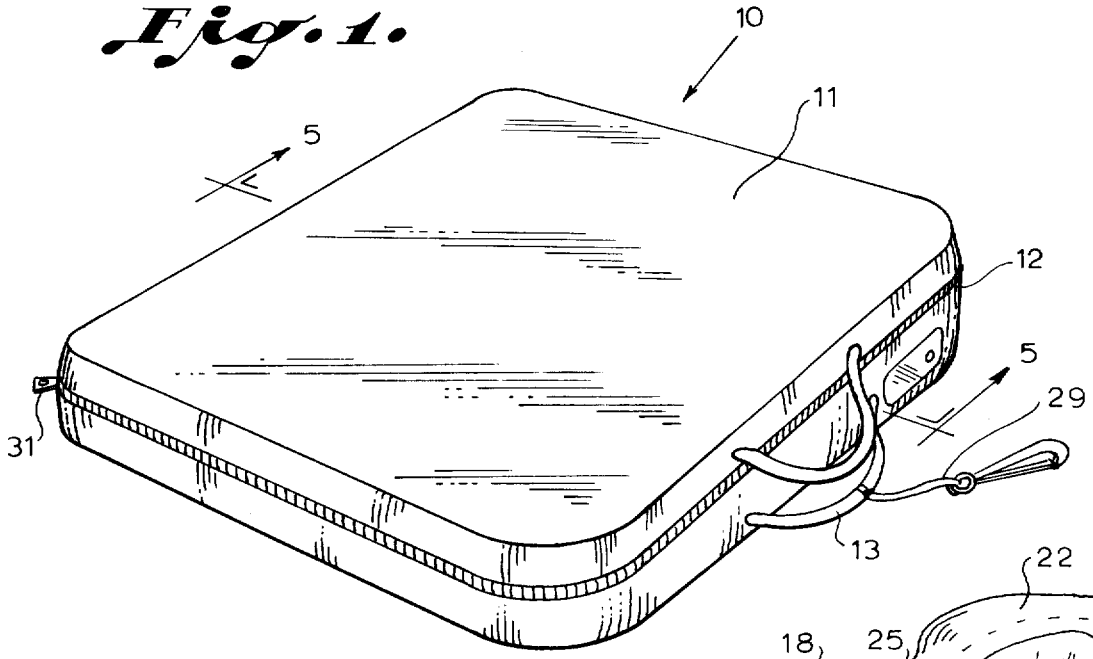
FIG. 1 is a perspective view of a folded cushion and garment in accordance with the present invention.
Figure 2:
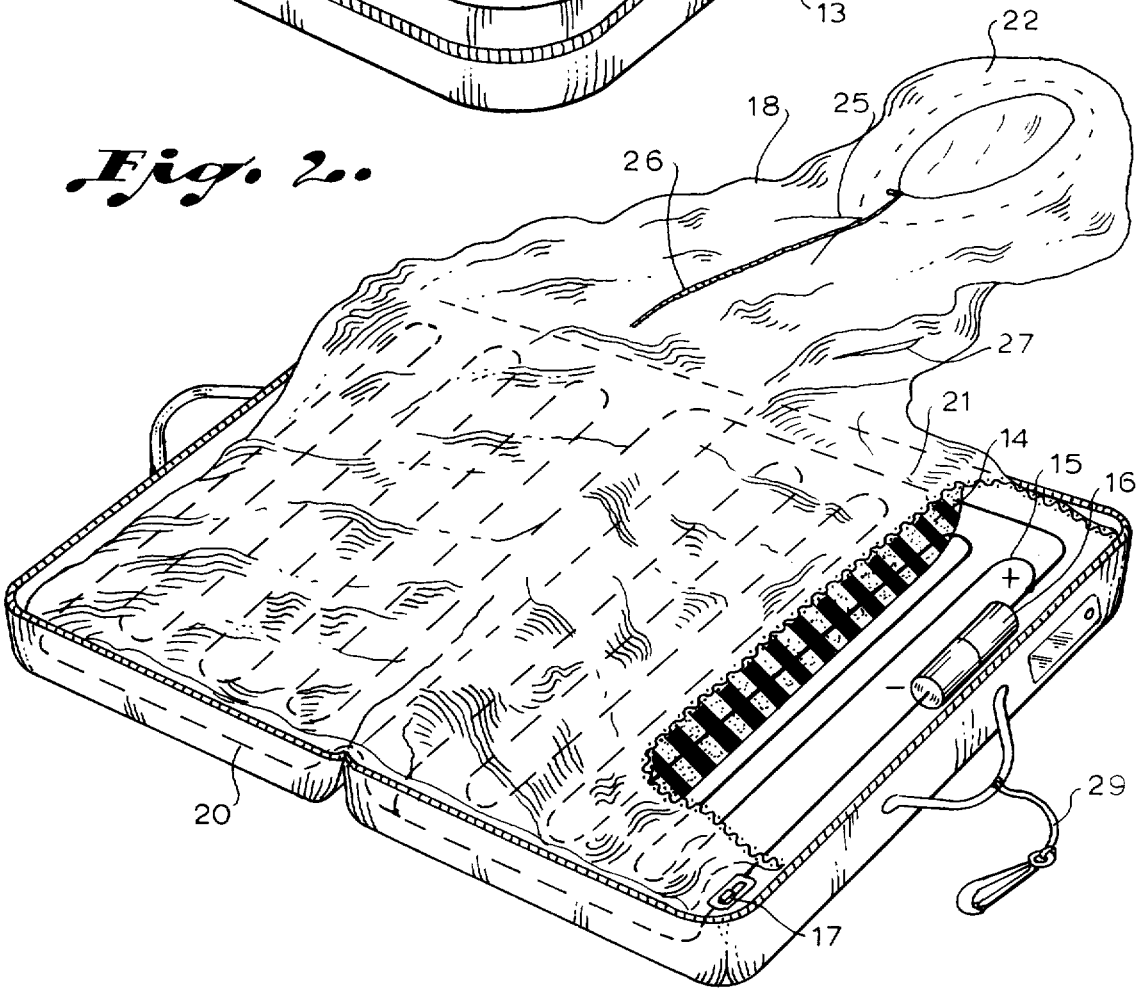
FIG. 2 is a perspective view of a portable cushion and garment being unfolded for use.
Figure 3:
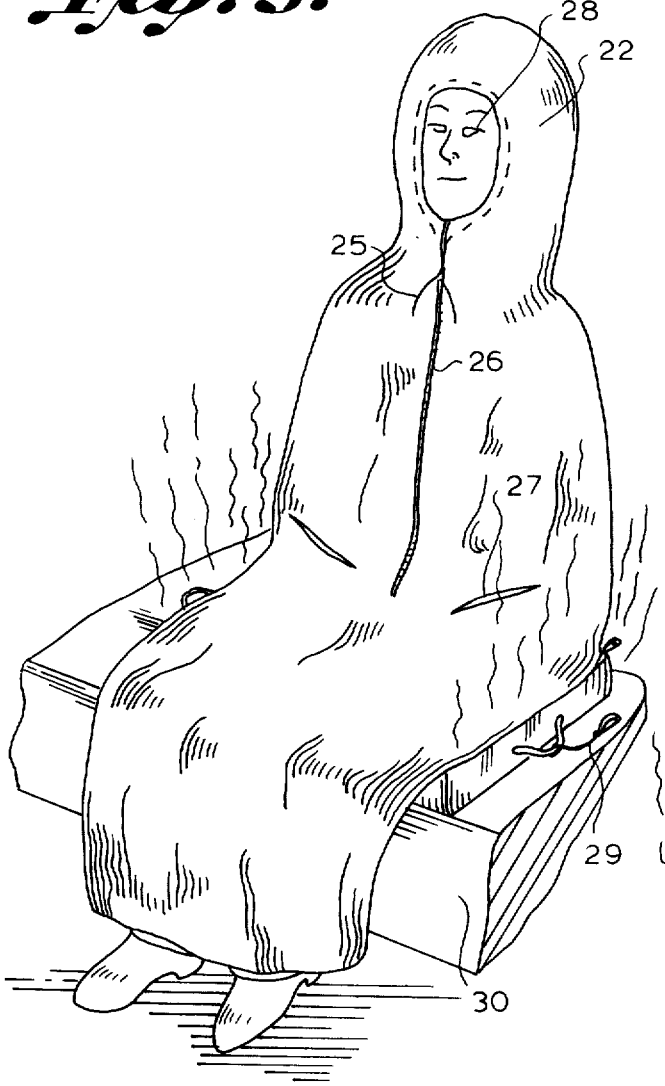
FIG. 3 is a perspective view of the unfolded cushion being used by an individual.
Figure 4:
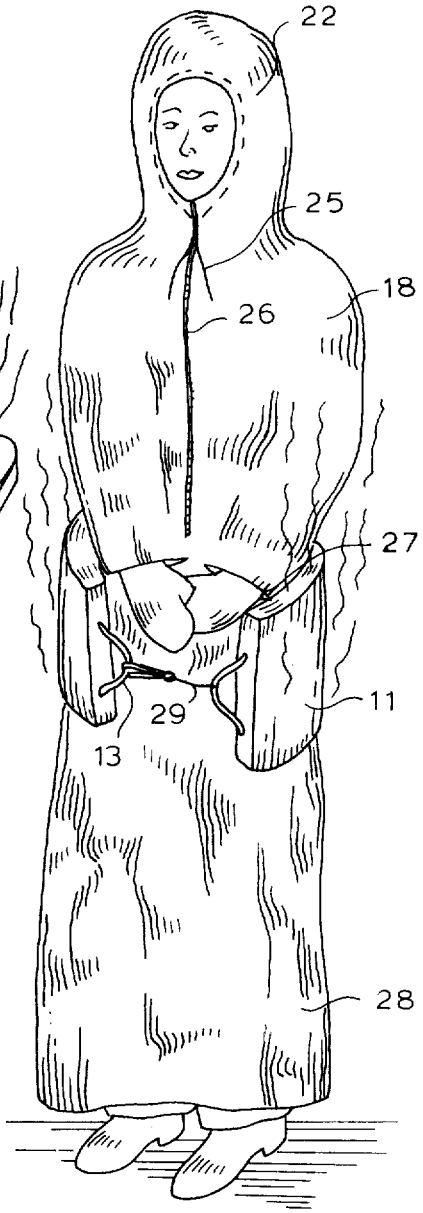
FIG. 4 is a perspective view of an individual utilizing the garment for standing events.

Referring to the drawings and especially to FIG. 1, a foldable cushion and garment apparatus 10 has a foldable case 11 which may be closed with a zipper 12 allowing the case 11 to be folded open as illustrated in FIG. 2. THe case 11 may be made of a flexible material such as flexible polymer material which has good resistence to moisture and may have a metal or vinyl zipper 12 and handles 13 for carrying the closed case 11. The cushion 10 is shaped like a small briefcase, but when opened the case is shown to have cushioning material 14 attached thereinside which may be foamed polyurethane or other foamed plastic or foam rubber which provides cushioning as well as insulation. This cushioning material 14 provides cushioning to an individual with the case closed as in FIG. 1 or opened as in FIG. 2. A resistance electrical wire 15 is wound in a serpentine fashion through the cushion and connected to an electrical power source, such as battery 16, and through an electrical switch 17 so that a small current through the resistance wire 15 will generate heat to assist in warming the user. A poncho type raincoat 18 is attached to the inside of both sides of the case 11 either to the edges 20 or to a covering 21 for the cushioning material 14. The raincoat 18 is attached so that it may be folded for closing the case 11, as illustrated in FIG. 1, and may be unfolded if needed by the user, as illustrated in FIGS. 3 and 4. The poncho 18 has a head covering 22 which may have draw strings 25 for pulling the head covering 22 tight around the individual's face. In addition, the poncho 18 has a zippered front 26 to allow entry and exit from the poncho as well as a pair of slits 27 for extending and retracting the hands and arms of the user as desired. The poncho 18 may be made of any material desired but typically would be made of a waterproof, weatherproof material so as to act as a raincoat for protection against rain and snow, but which would also provide some insulation against cold. Thus, the individual user as illustrated in FIG. 3 can be cushioned against the hard seats of stadiums or fishing boats or hunting blinds while being kept warm inside of the weather protecting garment 18 with or without the use of the head covering 22. The case 11 may be carried by the handles 13 to sporting events or for use in any outdoor activity and may provide space therein for carrying a thermos, program, or the like.

FIG. 4 illustrates the use of a strap or belt 27 which allows the carrying case 11, along with the cushioning material 21, to be attached around the user by attaching the handles 13 together with the strap 27. Strap 28 may have a buckle or clasp for easily attaching and removing the cushioning from around the individual's waist. This allows the use of the garment 18 for standing events while allowing the cushioning material to act as additional insulation and allowing the electrical heater to be used for providing additional warmth. The individual 28 can thus use the device setting on a bleacher 30, in a boat or standing as in FIG. 4.

Figure 5:
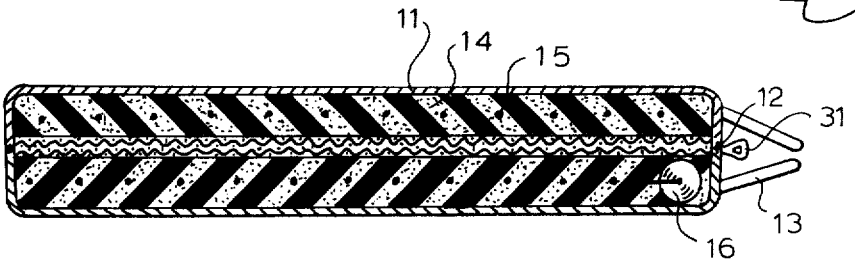
FIG. 5 is a sectional view taken on a line 5—5 of FIG. 1.

FIG. 5 is a sectional view having the casing 11 having the insulation material 14 mounted to either side thereof with the resistent wiring 15 passing therethrough and having the batteries 16 attached therein with the handles 13 connected to the case 11. A zipper handle 31 for opening and closing the zipper 12 is also illustrated. Thus, the present invention provides in one convenient case, not only cushioning and carrying compacity, but a garment for the protection of the owner from inclement weather which can be conveniently stored at home or in an automobile when not being used. It will of course be clear that variations are comtemplated as being within the scope of the present invention so that the particular shape and style of the raincoat 18 can be varied without departing from the spirit and scope of the invention. Accordingly, the present invention is not to be construed as limited to the particular forms disclosed herein which are to be regarded as illustrative rather than restrictive.

I claim:

1. A portable heated cushion and garment apparatus comprising in combination:

a foldable carrying case having a pair of connected halves;

a cushion means attached inside of each half of said carrying case;

a poncho raincoat having a headcovering with a drawstring therein, said raincoat attached to the inside of said foldable carrying case and said foldable carrying case having a folded position for enclosing said raincoat in said carrying case while forming additional cushioning and an unfolded position for partially covering a user in inclement weather whereby a portable cushioning and weather-shielding garment may be easily transported and stored;

a battery-powered electrical heating element mounted in both halves of said carrying case cushion means; and connecting means for connecting said foldable carrying case around the waist of a user wearing said raincoat whereby said user can be warmed whether seated or standing.

2. The apparatus in accordance with claim 1 in which said raincoat has a zippered front and arm openings therein.

3. The apparatus in accordance with claim 1 in which said foldable carrying case has a pair of handles thereon.

4. The apparatus in accordance with claim 3 in which said connecting means is a flexible strap.

* * * * *